United States Patent [19]

Nozaki et al.

[11] Patent Number: 4,741,634

[45] Date of Patent: May 3, 1988

[54] PRINTER WITH VARIABLE HEAD DISPLACEMENT

[75] Inventors: Mineo Nozaki, Kawasaki; Osamu Asakura, Tokyo; Masasumi Nagashima, Yokosuka, all of Japan

[73] Assignee: Canon Kabushiki Kaisha, Tokyo, Japan

[21] Appl. No.: 873,294

[22] Filed: Jun. 9, 1986

Related U.S. Application Data

[63] Continuation of Ser. No. 672,867, Nov. 19, 1984, abandoned, which is a continuation of Ser. No. 483,201, Apr. 8, 1983, abandoned, which is a continuation of Ser. No. 266,116, May 21, 1981, abandoned.

[30] Foreign Application Priority Data

May 30, 1980 [JP] Japan ..... 60-72510

[51] Int. Cl.[4] ..... B41J 3/20; B41J 19/58

[52] U.S. Cl. ..... 400/120; 400/175; 400/306

[58] Field of Search ..... 400/120, 175, 303, 306

[56] References Cited

U.S. PATENT DOCUMENTS

| | | | |
|---|---|---|---|
| 3,989,131 | 11/1976 | Knirsch et al. | 400/124 X |
| 4,000,393 | 12/1976 | Cochran et al. | 400/120 X |
| 4,030,587 | 6/1977 | Walker | 400/120 X |
| 4,050,563 | 9/1977 | Menhennett | 400/124 |
| 4,074,798 | 2/1978 | Berger | 400/306 X |
| 4,114,750 | 9/1978 | Baeck et al. | 400/328 X |
| 4,128,346 | 12/1978 | Ragland | 400/320 X |
| 4,213,714 | 7/1980 | Jones et al. | 400/124 |
| 4,265,555 | 5/1981 | Burkhardt | 400/305 |
| 4,350,448 | 9/1982 | Hanagata, et al. | 400/120 |
| 4,396,923 | 8/1983 | Noda | 346/76 PH |
| 4,411,540 | 10/1983 | Nozaki et al. | 400/175 |

FOREIGN PATENT DOCUMENTS

| | | | |
|---|---|---|---|
| 2928304 | 1/1980 | Fed. Rep. of Germany | 400/120 |

OTHER PUBLICATIONS

*IBM Tech. Disc. Bulletin*, "Print Element Pitch Selection", by R. D. Mathews, vol. 19, No. 6, Nov. 1976, p. 1959.

*Primary Examiner*—Paul T. Sewell

*Attorney, Agent, or Firm*—Fitzpatrick, Cella, Harper & Scinto

[57] ABSTRACT

This invention provides a printer capable of regulating the displacement of printing head according to the kind of characters to be printed. The printer has a printing head, an identifying device for identifying the print size of the printing head, and a drive mechanism for driving the printing head according to the print size identified by the identifying device.

9 Claims, 3 Drawing Sheets

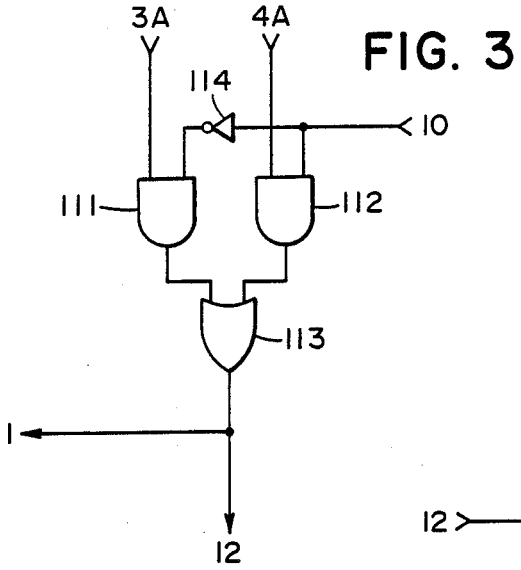
FIG. 3
FIG. 4
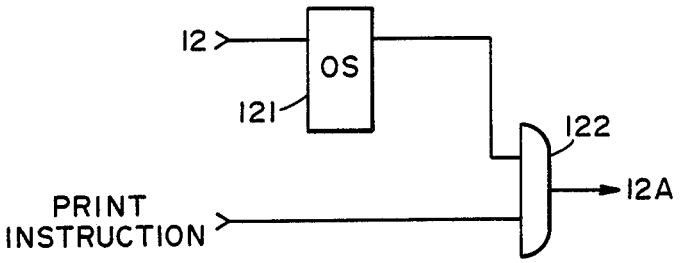
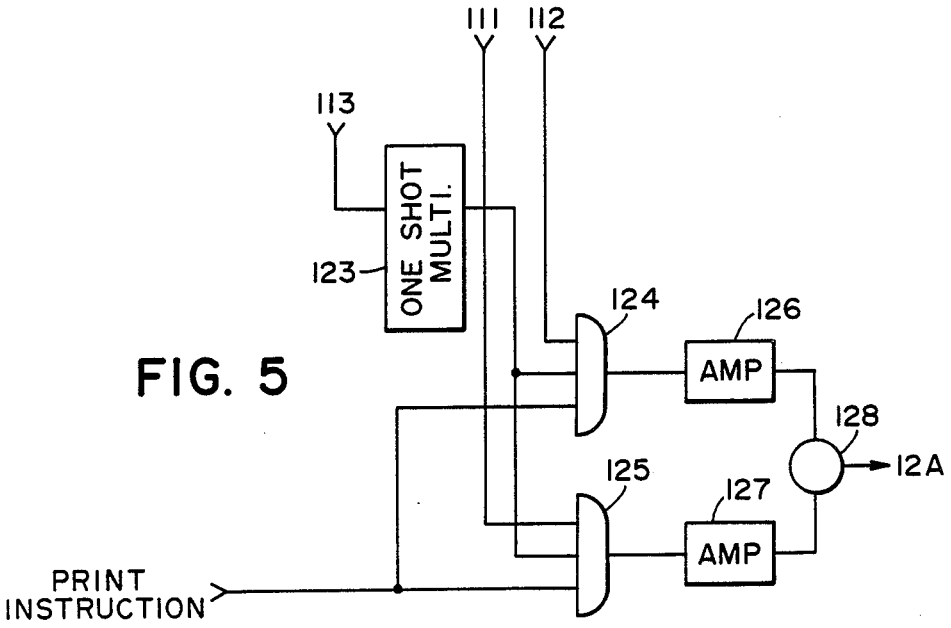
FIG. 5

PRINTER WITH VARIABLE HEAD DISPLACEMENT

This application is a continuation of application Ser. No. 672,867 filed Nov. 19, 1984, now abandoned, which in turn is a continuation of U.S. Ser. No. 483,201, filed Apr. 8, 1983, now abandoned, which in turn is a continuation of U.S. Ser. No. 266,116, filed May 21, 1981, now abandoned.

BACKGROUND OF THE INVENTION

1. Field of the Invention

The present invention relates to a printer with variable displacement of the printing head according to the species thereof.

2. Description of the Prior Art

In printers, for example serial thermal printers, the carriage supporting the thermal head is generally displaced by a stepping motor because of simplicity in the drive circuit and ease of control in causing reciprocating motion. However, because of the constant rotating angle of the stepping motor, the displacing pitch of the carriage remains always constant and cannot be modified in the serial printing direction when the thermal head is changed for modifying the typefont, for example changing the print size from 12 points to 9 points, so that the characters cannot be printed in the proper manner.

SUMMARY OF THE INVENTION

The object of the present invention, achieved in consideration of the aforementioned drawback, is to provide a printer capable of modifying the print pitch properly according to the kind of characters to be printed by the printing head.

Another object of the present invention is to provide a printer capable of identifying the print size obtained by the printing head.

Still another object of the present invention is to provide a printer capable of modifying the printing drive of the printing head according to the print size to be obtained therefrom.

Still another object of the present invention is to provide a printer having means for identifying the print size memorized in the detachable printing head.

Still other objects and features of the present invention will become apparent from the following description of embodiments thereof.

BRIEF DESCRIPTION OF THE DRAWINGS

FIG. 3 is a diagram of the selecting circuit;

FIG. 4 is a diagram of the head drive circuit; and

FIG. 5 is a diagram showing another embodiment of the selecting circuit.

DESCRIPTION OF THE PREFERRED EMBODIMENTS

Now the present invention will be explained in detail with reference to an embodiment thereof shown in the attached drawings.

Figure 1:
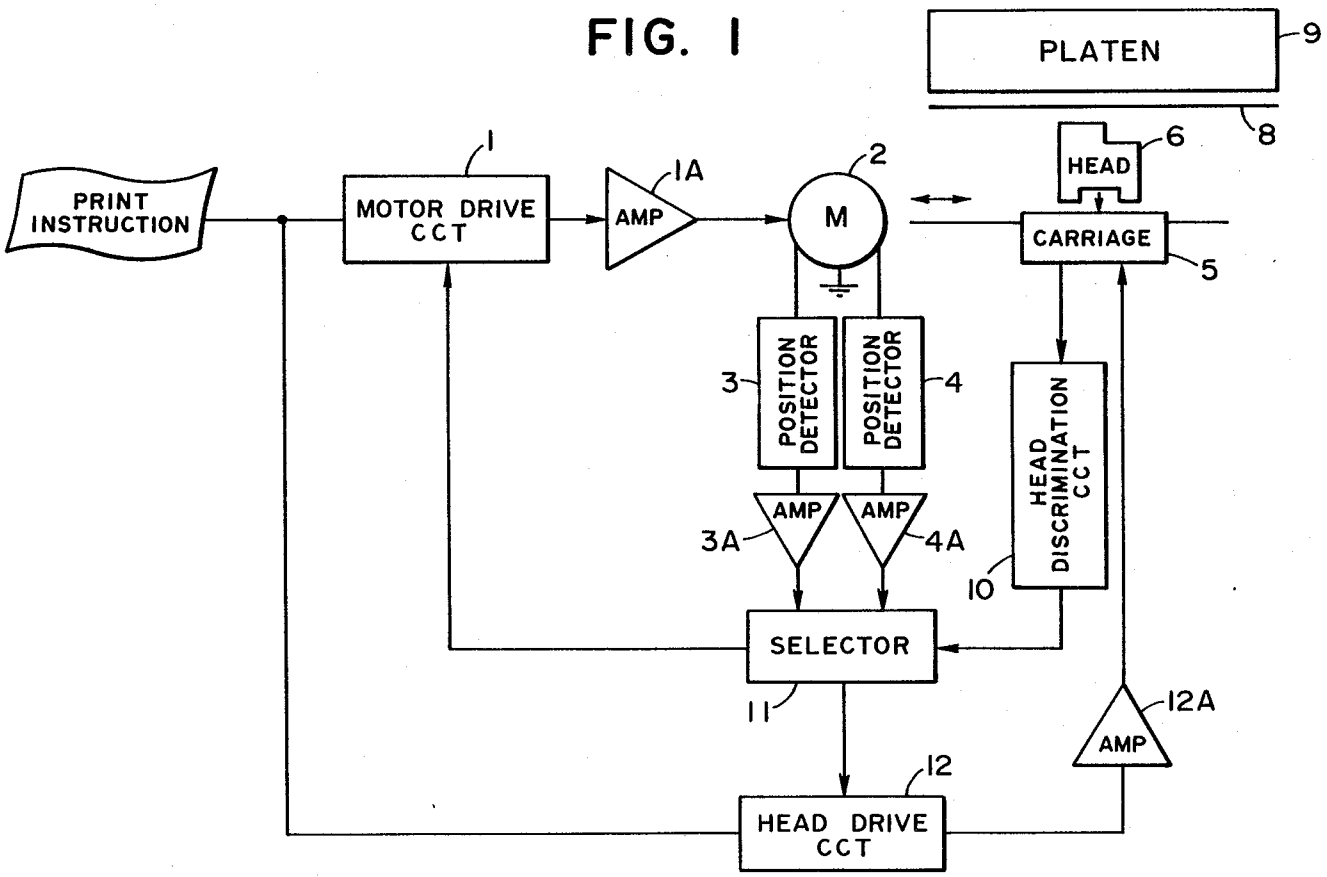
FIG. 1 is a block diagram showing the composition of a thermal printer embodying the present invention.

FIG. 1 is a schematic diagram of a printer embodying the present invention, wherein a servo-motor drive circuit 1 drives a servo-motor 2 through an amplifier

1A. Said servo-motor 2 is provided with position detectors 3, 4, of which signals are amplified by amplifiers 3A, 4A. Thus, the detectors 3, 4, composed of slits and optical elements, provide pulses of different timings in response to the rotation of the servo-motor 2. The servo-motor 2 is mechanically connected, through unrepresented gears, wires etc., to carriage 5 supporting a thermal head having plural heating elements arranged in a vertical line and performing reciprocating motion along the printing direction in response to the rotation of the servo-motor 2. The carriage 5 is provided with a connector 7 for detachable mounting of the printing or thermal head 6 and electrical connections therefor. In facing relationship to the heating elements of the thermal head 6 there are provided a recording paper 8 and a platen 9, with which the thermal head 6 is maintained in pressure contact during the printing operation. A head discrimination circuit 10 is connected to the connector 7 supporting the thermal head, in order to identify the kind of the thermal head mounted. A selecting circuit 11 selects the timing pulses either from the detector 3 or from the detector 4, in response to the signal from the head discrimination circuit 10. The output signal from said selecting circuit 11 is supplied to the motor drive circuit 1 controlled by the print instruction signal, thus controlling the rotating speed of the servo-motor. Said output signal is also supplied to a head drive circuit 12 to determine the drive time of the thermal head 6 maintained in stand-by state by the print instruction signal and accordingly drive said thermal head.

Figure 2:
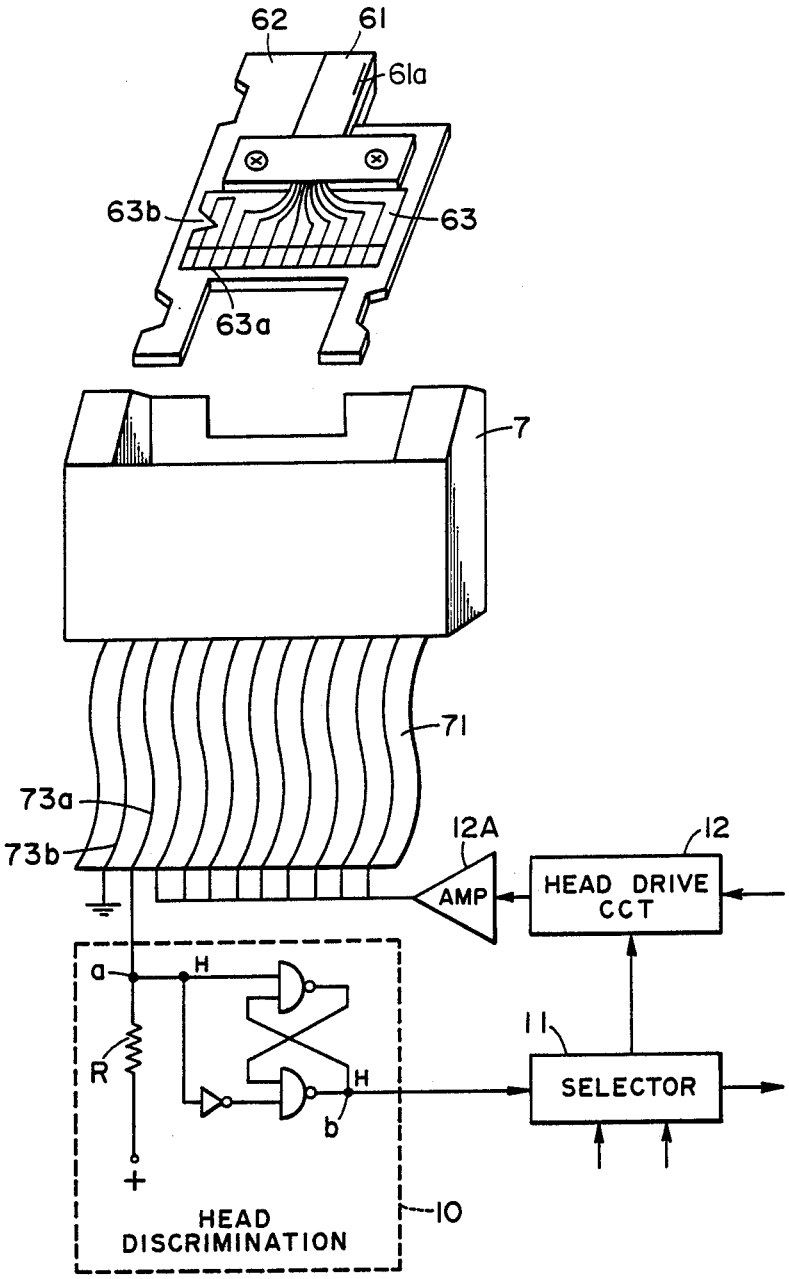
FIG. 2 is a schematic view of a thermal head embodying the present invention.

FIG. 2 shows an embodiment for discriminating the kind of the thermal head 6. The thermal head 6 is composed of a graze area 61, a heat element area 61*a*, a printed circuit board 63 connected thereto and a heat sink 62, wherein said graze area and printed circuit board are screwed to the heat sink to constitute a thermal head unit. The circuit patterns on the board 63 include U-shaped patterns 63*a*, 63*b* not connected to the heat elements 61*a*, in which the pattern 63*b* has a partially disconnectable structure and is cut off according to the print size. The connector 7 has a flexible cable 71 which connects to the printed circuit board 63 of the thermal head 6, wherein a lead wire 73*b* which connects to the pattern 63*b* is grounded whereas a lead wire 73*a* which connects to the pattern 63*a* is connected to the input terminal a of the head discrimination circuit 10. The head discrimination circuit 10 is composed of a latch circuit having the same signal level at the input a and output b thereof, and also has a function of preventing erroneous printer operation by the noise at the insertion of the thermal head 6.

FIG. 3 shows the details of the selecting circuit shown in FIG. 1, wherein shown are AND gates 111, 112 of transmitting either the signal from the position detector 3 or the signal from the position detector 4 in response to the signal from the head discrimination circuit 10, an OR gate 113 for transmitting the signal from the position detector 3 or 4 to the motor drive circuit 1 and the head drive circuit 12, and an inverter 114.

FIG. 4 shows the details of the head drive circuit 12 composed of a one-shot multivibrator 121 triggered by the signal from the selecting circuit 11, and an AND gate 122, wherein the drive time of the print head is determined by said one-shot multivibrator 121.

FIG. 5 shows another embodiment of the head drive circuit 12 in which the voltage supplied to the print head is regulated according to the print size. In FIG. 5 there are shown a one-shot multivibrator 123 to be triggered by the output signal from the OR gate 113 of the selecting circuit 11; AND gates 124, 125 to be controlled by the output signals from and AND gates 111, 112; amplifier 126, 127 respectively providing signals for different voltages thereby applying a higher voltage in a larger print size; and an adding circuit 128 for transmitting the output from the amplifiers 126, 127 to an amplifier 12A.

The above-explained thermal printer functions in the following manner. Upon insertion of the thermal head 6 into the connector 7 of the carriage 5, the input terminal a of the head discrimination circuit 10 connected to the power supply through a resistor R changes the potential level according to the kind of thermal head 6 inserted, since the pattern 63*a* on the printed circuit board 63 of the thermal head 6 is connected to said input terminal a of the head discrimination circuit 10 through said connector 7, while the lead wire is grounded. Thus, upon insertion of a thermal head 6 corresponding to a 12-point print size in which the circuit pattern 63*b* is cut off, the input terminal a and the output terminal b of the head discrimination circuit 10 assume level "1". On the other hand, upon insertion of a thermal head 6 corresponding to a 9-point print size in which the circuit pattern 63*b* is not cut, the input terminal a and the output terminal b of said head discrimination circuit 10 assume level "0". In response to the automatic discrmination of the thermal head 6 in this manner by the head discrimination circuit 10, the selecting circuit 11 selects the position detector 3 or 4 for position detection for power supply to the thermal head 6. Upon receipt of a print instruction signal a state occurs where the carriage 5 is loaded with the thermal head 6, the servo-motor 2 is activated through the motor drive circuit 1 and the amplifier 1A to displace the carriage 5 and the thermal head 6 in the print direction. In this state the output signal from the selecting circuit 11 is supplied as a feedback signal to the motor drive circuit 1 to control the servo-motor 2 at a constant speed corresponding to the 12-point or 9-point thermal head. When the position detection signal is transmitted from the selecting circuit to the head drive circuit 12 in the course of the carriage displacement, said head drive circuit 12 maintained in the stand-by state by the print instruction signal determines the head drive time and activates the heat elements 61*a* through the amplifier 12A, connector 7 and printed circuit board 63 at a defined position of the recording paper, thereby achieving thermal printing. In this manner the displacing speed of the carriage 5 is regulated according to the kind of the thermal head 6, thus modifying the active position with respect to the recording paper 8 and forming proper characters. Naturally such proper head displacement can be achieved by appropriate regulation of the carriage displacement speed or the timing of power supply to the head along.

The present invention is not limited to the foregoing embodiment but is also applicable to a dot matrix thermal head for example 5×7 elements, or other printing heads such as a wire dot print head or a print head with printing types. Furthermore, head discrimination is not limited to two different kinds but can be extended to three or more different kinds, and the discriminating can also be modified in various manners. Also it is possible to obtain plural different prints from a same printing head if the discrimination is rendered manually selectable.

As explained in the foregoing, the present invention allows to print different characters with exchangeable thermal print head by discriminating the kind of characters of said print head and accordingly controlling the speed and position of the print head, and is extremely in extending the range of printing with a simple structure.

What we claim is:

1. A printer comprising:

a carriage;

a printing head including conducting means and a plurality of print elements, said conducting means having a plurality of conductors arranged substantially in a plane, and a common connector portion for connecting said conductors to the printer, a first portion of said plurality of conductors modifying a signal applied to said first portion in accordance with a print size printed by said printing head, another portion of said plurality of conductors conveying a drive signal for driving said plurality of print elements;

means for supplying the signal to said printing head;

discriminating means for identifying the print size in accordance with the signal modified by said conducting means; and drive means, responsive to said discriminating means, for driving said printing head at a rate appropriate to the print size represented by the print signal identified by said discriminating means.

2. A printer according to claim 1, wherein said drive means includes control means for controlling the displacement of said printing head.

3. A printer according to claim 1, further comprising moving means for displacing said printing head.

4. A printer according to claim 2, further comprising position signal generating means for generating two position signals in response to the displacement by said moving means of said printing head.

5. A printer according to claim 4, further comprising means for selecting either one of the two position signals generated by said position signal generating means in response to the discrimination by said discriminating means so as to apply the two position signals to said drive means.

6. A printer according to claim 1, further comprising latch means for storing information identified by said discriminating means.

7. A printer according to claim 1, further comprising connector means for connecting said carriage to said printing head.

8. A printer according to claim 1, further comprising connector means connected to said discriminating means and said drive means, and detachably connected to said plurality of conducting means.

9. A printing head comprising:

a plurality of print elements;

indicating means for indicating a print size to be printed by said print elements, said indicating means being formed on a printed circuit board and including a predetermined pattern of conductors, said pattern being selectively modified in accordance with the print size; and conducting means for conveying a size signal indicated by said indicating means and for conveying a drive signal for driving said print elements, said conducting means being formed on the printed circuit board with said indicating means and being electrically connected to said print elements and to said indicating means.

* * * * *